US005727127A

United States Patent [19]

Schulze Horn et al.

[11] Patent Number: 5,727,127

[45] Date of Patent: Mar. 10, 1998

[54] METHOD FOR CONTROLLING A PRIMARY INDUSTRY PLANT OF THE PROCESSING INDUSTRY

[75] Inventors: Hannes Schulze Horn, Gladbeck; Juergen Adamy, Igensdorf, both of Germany

[73] Assignee: Siemans Atkiengesellschaft, Munich, Germany

[21] Appl. No.: 463,446

[22] Filed: Jun. 5, 1995

[30] Foreign Application Priority Data

Mar. 9, 1995 [DE] Germany ..... 195 08 476.4

[51] Int. Cl.[6] ..... G06F 15/18

[52] U.S. Cl. ..... 395/10; 395/50; 395/53

[58] Field of Search ..... 395/23, 24, 10, 395/22, 167, 50, 53, 60–61; 364/472

[56] References Cited

U.S. PATENT DOCUMENTS

| | | | |
|---|---|---|---|
| 5,408,586 | 4/1995 | Skeirik | 395/23 |
| 5,412,756 | 5/1995 | Bauman et al. | 395/53 |
| 5,455,773 | 10/1995 | Frey | 364/476 |

FOREIGN PATENT DOCUMENTS

| | | |
|---|---|---|
| 0 138 059 | 4/1985 | European Pat. Off. . |
| 0 228 038 | 7/1987 | European Pat. Off. . |
| 0 411 962 | 2/1991 | European Pat. Off. . |
| 31 41 560 | 8/1982 | Germany . |
| 31 33 222 | 1/1988 | Germany . |
| 41 25 176 | 2/1993 | Germany . |
| 42 09 746 | 9/1993 | Germany . |

OTHER PUBLICATIONS

VDI Berichte, 1113, Conference of 22 & 23 Mar. 1994, H.P. Preuss et al.: *Fuzzy Control*, pp. 89–123.

METEC Conference, Jun. 1994, Mitsubishi Heavy Industries Ltd./Nippon Steel Corp.: *Development of Twin Drum Strip Caster for Stainless Steel*, K. Yanagi et al.

Mettalurgical Plant and Technology International, May 1994, pp. 52–58; Hubert Preissl et al.: *Process Optimization for Maximum Availability in Continuous Casting*.

Control Eng. Practice, vol. 2, No. 6, pp. 961–967, 1994, S. Bernhard et al.: *Automation of a Laboratory Plant for Direct Casting of Thin Steel Strips*.

Mettrey, "A Comparative Evaluation of Expert System Tools," Computer Magazine, vol. 24, Issue 2, Feb. 28, 1991.

*Primary Examiner*—Tariq R. Hafiz

*Attorney, Agent, or Firm*—Kenyon & Kenyon

[57] ABSTRACT

A method for controlling a primary industry plant of the processing industry, for example, in a steel plant or a rolling mill in order to, for instance, produce strips of steel or non-ferrous metals. The control method is designed in terms of computer engineering building on inputted advance knowledge, such that the method can automatically recognize the state of the installation and details of a manufacturing process taking place in the installation, for example in a continuous casting process for strips, and is able to give desired values and setpoints appropriate for the situation to achieve a reliable and successful production.

20 Claims, 5 Drawing Sheets

METHOD FOR CONTROLLING A PRIMARY INDUSTRY PLANT OF THE PROCESSING INDUSTRY

FIELD OF THE INVENTION

The present invention relates to a method for controlling a primary industry plant of the processing industry, or the like, in for example a steel plant or a rolling mill in order to, for instance, produce strips of steel or non-ferrous metals. The control method is designed in terms of computer engineering building on inputted advance knowledge, such that the present invention can automatically recognize the state of the installation and details of a manufacturing process taking place in the installation, for example, in a continuous casting process for strips, and is able to give desired values and setpoints appropriate for the situation to ensure a successful production.

BACKGROUND INFORMATION

In industrial installations producing or processing goods or energy, there has always been a need for a control method, which would allow optimal and, in particular, cost-effective control of the process being run in the installation. In known methods heretofore, to the extent that was possible, this need has been met suboptimally by conventional control engineering devices. However, in production processes which entail substantial problems with respect to control engineering, in particular, the outlay required for control engineering rises enormously, without a satisfactory result actually being attained.

In the case of metal strip casters, whose operation entails quite substantial control engineering problems, which will, therefore, be elucidated in the following, it is already known to work with interconnected individual closed-loop controllers or control circuits. Examples are disclosed by European Patent No. 0 138 059 A1 and European Patent No. 0 228 038, as well as by the essay "Development of twin-drum strip caster for stainless steel" by K. Yanagi, inter alia (Metec Conference, June 1994, Mitsubishi Heavy Industries, Ltd./Nippon Steel Corp.). The known closed-loop control systems, which work suboptimally, although they are already equipped to some extent with controllers which utilize mathematical models, result in the manufacturing of strips, whose dimensional accuracy and quality are still subject to relatively large fluctuations. What is especially disadvantageous in this case is that the installations, which work with the known closed-loop controllers or control circuits, require fast, preferably hydraulic actuators, which are very expensive.

To avoid the above disadvantages, at least to some extent, it is known to use expert systems. Expert systems, so-called intelligent systems, are supposed to be able to improve the quality of the manufactured products with respect to those quality features that are not easily controlled using control engineering, and are also known for installations in the raw materials industry, as shown in, for example, the essay "Process optimization for maximum availability in continuous casting", published in the periodical "Metallurgical Plant and Technology International 5/1994". Expert systems of this type, which are perfectly capable of improving the success of production, do not eliminate the principal weaknesses of the conventional closed-loop control systems, however. These weaknesses become especially apparent in processes that cannot be directly controlled (such as in the raw materials industry), because of the lack of suitable sensors, for instance within high-temperature processes.

In controlling the casting of steel strips using indirect closed-loop control systems, it is known, in addition, from European Patent No. 0 411 962 A2 to work with a set of curves of permissible input variables as a basis for control installations. The set of curves reproduces the profile characteristic curve of positively identified constellations of input variables. A procedure of this type, in which expert knowledge is turned into installation control by specifying setpoint values, requires costly installation performance tests to determine new control curves when there are changes in quality or requirements. Moreover, an operation can only be performed far below the process optimum.

SUMMARY OF THE INVENTION

An object of the present invention is to specify a control method, which will make it possible to reliably achieve a more successful production in inexpensive installations, in particular for production processes which are typically difficult to control, such as the casting of metal strips.

The present invention is a designed intelligent control system, which, by building on inputted advance knowledge, automatically gives instructions comprising desired values and setpoints applicable to the situation for a reliable and best possible (optimal) process control. Thus, it is a question of a fully developed technical intelligence, which, surprisingly, can already be realized with the computer technology available today for process control systems of large installations as well.

The refinement of the present invention provides that the control method be designed to optimize the instructions applicable to the situation step-by-step using computer technology [computational means]. As a result, the intelligent performance is boosted further, thus leading to a quality of process control that is not attainable by human service personnel, or at least not within the short time that can be achieved with the computer technology.

A further refinement of the present invention provides for inputted advance knowledge, the process knowledge entered by humans, to be continually improved, preferably automatically, by computer-generated knowledge gained internally, e.g. in various working points during production, and for this self-generated process knowledge to be accepted as new advance knowledge in a data storage unit, in particular, a continually updated data storage unit. Thus, a continually improved foundation for further adapting or optimizing the process is created quite advantageously. The knowledge gained is not merely restricted in this case to more precise parameters, etc., but also includes, in particular, the principles of the applied algorithms, etc.

To reliably attain a successful production, in particular, which will establish a foundation for the customer's confidence in such a system, it is provided for the control system to have a basic [reference] function system for the installation components, to reliably convert the instructions from the knowledge gained computationally, e.g. from a process model, preferably a complete process model, into the installation control. By combining a reliable basic function system, which is preferably developed as a basic automation system and reliably renders each of the installation components in itself, or all of them combined, operational, with a static process model that is adapted to the particular situation, one can achieve a design that is at least equivalent, in terms of the reliability of the process control, to a conventionally designed control system, but that is superior with respect to the cost-benefit ratio and the process result that can be reliably attained.

A particular advantage here is that the instructions applicable to the situation, e.g. in the form of setting values, are given directly to the installation components in the form of selection [triggering] values, for instance for positions or, in particular, indirectly, e.g. via controller setpoint values, for rotational speeds. The instructions are determined, quite advantageously, directly from the variables of the process model. For time-critical setpoint values, this takes place advantageously on-line, otherwise off-line. Thus, one attains an especially beneficial reaction of the installation to modified process conditions and, advantageously at the same time, possibly economizes on setpoint computing devices.

To increase operational reliability, the basic automation system is advantageously developed as an autonomous subsystem that guarantees a reliable condition of the installation or of the installation components and of the process state, e.g. as an emergency-condition release system, which instead of falling back on computer-generated instructions, can optionally fall back on positively identified operational values stored in the data storage unit. Thus, the installation can work reliably, even if suboptimally, even in the event of a failure or malfunctioning of the intelligent part of the computer.

The basic functioning system also advantageously has starting and run-up routines, which can be entered manually or automatically, as well as suboptimal normal operating routines, in which individual, otherwise computer-generated instructions can be replaced by constant, reliable setpoint inputs [defaults]. Such a refinement of the basic function system is particularly advantageous for the initial operation phases and for an operation with sudden requirement changes, etc. For the intelligent computer part to function, even if suboptimally, it is also not necessary for all model parts to always be available in a specifically adapted form. An operation is also advantageously possible with an only partially developed and/or adapted complete process model.

The process model itself, particularly in the form of a complete process model, has a modular design, and describes the performance characteristics among the process input variables, as well as the manipulated variables, and the process output variables, e.g. quality characteristic values of the manufactured product. In this case, the modularity allows an especially advantageous refinement and processing of the complete process model, since one can start out from individual, easily assessed submodels. To the extent that is possible, the process model is advantageously based on mathematical descriptive forms. Where such mathematical descriptive forms are not possible, one falls back, for instance, on linguistically formulated model sections, which can be realized, for example, by fuzzy systems, neuro-fuzzy systems, expert systems, or the like. For completely new installation components, for example, for which it is not possible to produce a model based on the fundamentals of mathematical physics, chemistry or metallurgy, or the like, or based on linguistically describable process knowledge, self-learning systems, such as neural networks, are used. Thus, it is possible to create a complete process model for all production systems, regardless of how large their layout or design.

It is, of course, also possible to run the production process as is customarily done with the components for which inexpensive, conventional solutions are available. Then, the model module that would otherwise have been necessary in view of the effect of the utilized conventional component is suitably replaced. This procedure would possibly provide a solution in the reel winder area of a rolling mill.

The process model is advantageously continually adapted to the process on the basis of process data, which has been collected at the installation and filed in a process data base, and further improved, this taking place advantageously by means of adaptive methods, learning methods, for example by means of a back-propagation learning method, or also a selection method for various submodels, for instance neural networks or their components. The result is a model that, in essential parts, is self-learned and can be adapted or improved on-line or off-line.

One advantageous refinement provides for the adjustable process variables to be optimized by the optimizer at the process model so as to allow the model output variables, which, in particular, are quality parameters for the product, to conform as best possible to preselected, e.g. target values. The considerable computational expenditure associated with such processes can be controlled cost-effectively through an off-line processing. The off-line optimization can take place both on a separate processing unit in parallel to the model adaptation, as well as during downtimes, e.g. on the weekend or during the time required for corrective maintenance on that computer, for example, which outputs the control variables of the basic function system during operation.

The optimization takes place advantageously using known optimization methods, in particular by means of genetic algorithms. The optimization method is selected in dependence upon the situation and the problem at hand. It can take place both through a setpoint entry, for example based on an analysis of a process run, or through a computer-generated selection from a collection of optimization methods. To this end, a simple "trial and error" procedure can be applied, however, to reduce computational expenditure, it is recommended to bolster the "trial and error" method with convergency criteria, with methods for recognizing patterns during error checking, etc.

The specific starting values for an optimization are advantageously determined on the basis of the suboptimal operational data filed in a process data storage unit. Thus, the complexity of the optimization is lessened since the optimization calculation begins already with pre-optimized values, when it utilizes intermediate values that have been positively identified as starting values.

The improvement of the overall system takes place in at least three steps. The lowest step is the continual improvement of the existing process knowledge stored in the data storage unit, for example in the form of suboptimal, certain working points, which are automatically brought on an ongoing basis to a better adapted knowledge level, from which, in turn, one then proceeds further.

The second step is essentially the model adaptation, which adapts the model characteristics as best as possible to the process performance characteristics.

As a third step, the instructions applicable to the situation are continually improved by means of the process optimizer, for example through application of evolutionary strategies, genetic algorithms, etc. These strategies require considerable computing time and preferably take place off-line.

The process of improving the system is advantageously continually supported by external simulation calculations, model tests, and possibly also by tests at the production installation using new auxiliary devices, etc.

The control method according to the present invention is described in the following based on the example of a steel strip caster. Other, also inventive details and advantages are revealed in the drawings and in the description of the drawings.

DETAILED DESCRIPTION

Figure 1:
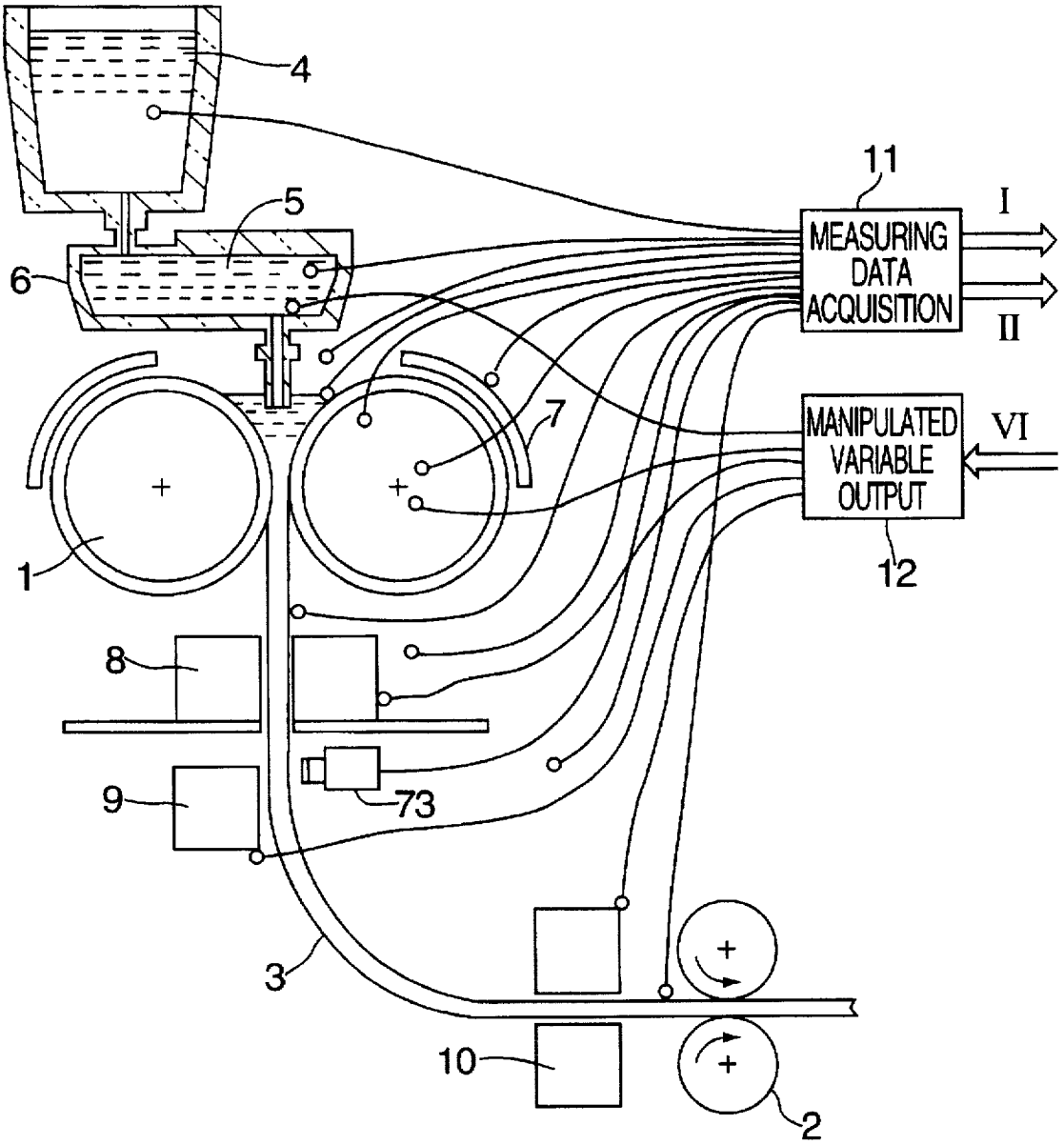
FIG. 1 shows a schematic representation of the strip caster including acquisition of measuring data and outputting of manipulated variables.

In FIG. 1, 1 describes the casting rolls of a two-roll casting device, the material, for instance molten steel, being fed in between the casting rolls 1 from the teeming ladle 4 via the tundish 5 and a well 6 and being solidified into a strip 3, which can be shaped [deformed] further in a roll arrangement symbolized by the circles 2 with arrows showing direction of rotation. The downstream roll arrangement can also be simply replaced by conveyor rolls, a reel winder, or the like, when the rolling out operation is not supposed to immediately follow the casting. The total installation is developed to correspond to the existing requirements. The installation situated downstream from the casting device can also be designed as a hot-cold roll mill, and this is recommended at very high casting speeds, since it will then allow the cold roll part of the installation to also be sufficiently utilized to capacity.

Between the casting rolls and the downstream devices, the casting roll device likewise preferably has only a symbolically depicted electrodynamic system 8, 9 and an induction heating system 10. The electrodynamic system component 8 is advantageously used in this case to remove load from the strip 3, which is still very soft here and, therefore, in danger of contracting, and the electrodynamic system component 9 is used to guide the strip 3, while the induction heating system 10 is responsible for adhering to a predetermined temperature profile across the width of the strip, when, for example, a subsequent deformation in a roll installation immediately follows. This is especially advantageous for types of steel that are sensitive to cracks. A camera 73 is used to control cracks in the cast strip 3, it being expediently possible to take advantage of the fact that the crack formation in the scale is influenced by cracks in the base material. A measured quantity is advantageously generated by a neuro-fuzzy system.

Since the surface temperature of the casting rolls is supposed to be essentially constant to avoid stresses caused by temperature changes, these casting rolls are kept at operating temperature by an IR heating system 7, an induction heating system, or the like, also in the area that does not come in contact with the molten steel. These and other individual components of the only roughly schematically drawn casting roll device are adjusted directly or with closed-loop control, for example, by means of temperature controllers, flow rate adjusting means, speed controllers, etc., within the scope of the basic automation via a manipulated-variable output 12. The actual data of the actuators, of the controllers, etc., are compiled and preprocessed in the measuring data acquisition unit 11 for the data storage device and the model input, as well as for the basic automation (not shown). By means of data transmission lines I, II and VI symbolized by arrows, the casting roll device, in which the solidification shells of the steel formed on the two casting rolls 1 are not only united, but are also shaped during rolling with correct preliminary dimensions, is linked to the intelligent part of the control system.

Figure 2:
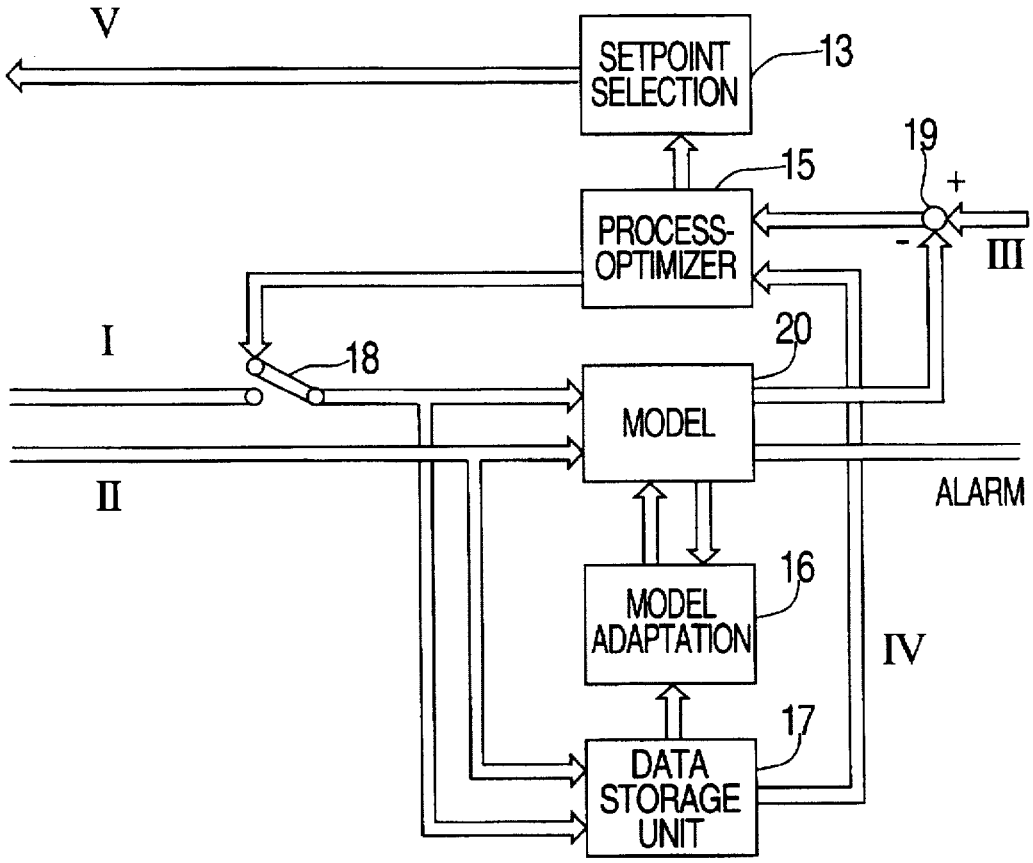
FIG. 2 shows the structure of the "intelligent" part of the control system comprising generation of setpoint value selection.

FIG. 2 depicts the structure of the intelligent part of the control system. This essentially consists of the components, process optimizer 15, model 20, model adaptation 16, and data storage device 17. These parts of the control system interact in such a way that by way of the setpoint value output 13, the best possible instructions applicable to the situation at hand are made available to the process control via the data line V. These instructions are then converted into setpoint values for the basic automation. The task and functioning of the individual components are described in the following.

The model 20 simulates the static process properties $$y_i = f_i(u_1, \ldots, u_p, \ldots, v_1, \ldots, v_p \ldots),$$

i.e., the dependency of the n model output variables $\tilde{y}_i$ on the manipulated variables $u_i$, which can be used to influence the process, and on the non-influenceable process variables $v_i$, such as the cooling water temperature. As already mentioned, the model output variables are typical quality parameters of the product. The model description $$\tilde{y}_i = \tilde{f}_i(u_1, \ldots, u_p, \ldots, v_1, \ldots, v_p \ldots),$$

generally does not exactly cover [apply to] the process characteristics, which is why $y_i$ and $\tilde{y}_i$ deviate from one another more or less. The manipulated variables $u_i$ and the non-influenceable process variables $v_i$ are transmitted $v_i$ are the data lines I and II.

The model adaptation 16 has the task of improving the model, so that the model characteristics will correspond as best as possible to the process characteristics. This can take place on-line, at least for model parts, in that these model parts are adapted or corrected on the basis of continually acquired process data.

For other model parts, the adaptation can also be carried out off-line at specific times. This is done based on a number m of the process states ($u_i^k$, $v_i^k$, $y_i^k$) representing the process which are stored in the data storage unit 17. The index k specifies the current process state. For this type of adaptation, the model error $$\begin{aligned} \epsilon &= \sum_{k=1}^{m} \sum_{i=1}^{n} (y_i^k - \tilde{y}_i^k)^2 \\ &= \sum_{k=1}^{m} \sum_{i=1}^{n} (f_i(u_1^k, \ldots, u_i^k, \ldots, v_1^k, \ldots, v_i^k, \ldots) - \\ &\quad \tilde{f}_i(u_1, \ldots, u_i, \ldots, v_1, \ldots, v_i, \ldots))^2 \end{aligned}$$

is minimized in dependence upon the model parameters or the model structure. This means that one varies the model parameters or model structure so as to allow $\epsilon$ to be as small as possible.

Through application of an optimization method and the process model, the process optimizer has the task of finding manipulated variables $u_i$, which lead to best possible process characteristics. The process optimizer works off-line at defined, for example, manually specifiable instants and, in fact as follows:

First, the non-influenceable manipulated variables $v_i$, for which the optimization is supposed to take place—e.g. the existing variables—, are kept constant and supplied to the model via the data line II. The process optimizer is then connected to the model via the switch 18. It feeds values of manipulated variables $u_i$ to the model. The output values $\tilde{y}_i$ are determined by means of the model. They are compared to the setpoint output values $y_{Soll,i}$, and the error $$E = \sum_{i=1}^{n} (y_{Soll,i} - \tilde{y}_i)^2$$

is determined.

Let's assume that the error E is to be minimized. For this purpose, the process optimizer varies the manipulated variables $u_i$ for so long in an iterative loop, which includes in each case the calculation of $y_i$ and E, as well as the new selection of $u_i$, until the error cannot be further diminished or one stops this optimization. As optimization methods, one can apply, for example, genetic algorithms, hill-climbing methods, etc.

The thus obtained optimal manipulated variables $u_{opt,i}$, which are the result of the above minimization, are then transferred as setpoint values via setpoint selection and the data line V to the basic function system.

The data storage device has the main task of filing representative process states ($u_i$, $v_i$, $y_i$). In this case, it continually replaces old process data with newly determined data, to render possible, on the basis of this new data, a current up-to-date process state, even for point-for-point process description. The data storage device then supplies the model adaptation as described above. On the other hand, it also supplies starting values $u_i$ for the process optimizer. The starting values are selected in this case, for example, so as to allow the output values $y_i$ belonging to these starting values to correspond as best as possible to the setpoint values $y_{Soll,i}$.

Therefore, the preferably off-line working loop, consisting of model 20 and process optimizer 15, which makes use of genetic algorithms, for instance, for evolutionary model improvement, for example, preferably works off-line, because due to the complexity of an installation control model with its many possible forms, the computing time of an evolutionary optimization process becomes comparatively long. Even in the case of good optimization strategies, which are selected, for example, based on an analysis of the probable model characteristics, many optimization processes are to be calculated through until a clear model improvement is achieved.

The essay, "Automation Of A Laboratory Plant For Direct Casting Of Thin Steel Strips" by S. Bernhard, M. Enning and H. Rabe in "Control Eng. Practice", vol. 2, no. 6, pp. 961–967, 1994, Elsevier Science Ltd., describes creating a model structure to be used in accordance with the present invention and an important submodel. From this publication, one can also gather, inter alia, the fundamental structures of suitable basic automation systems and of start-up routines, upon which one skilled in the art can build.

Suitable as computers for the process optimization and the parameter adaptation are work stations manufactured, for example, by the Sun Inc. Parallel working computers are advantageously used for large control systems. This applies, in particular, when the model can be divided up into groups of model modules, which can be optimized partially in dependence upon one another.

Figure 3:
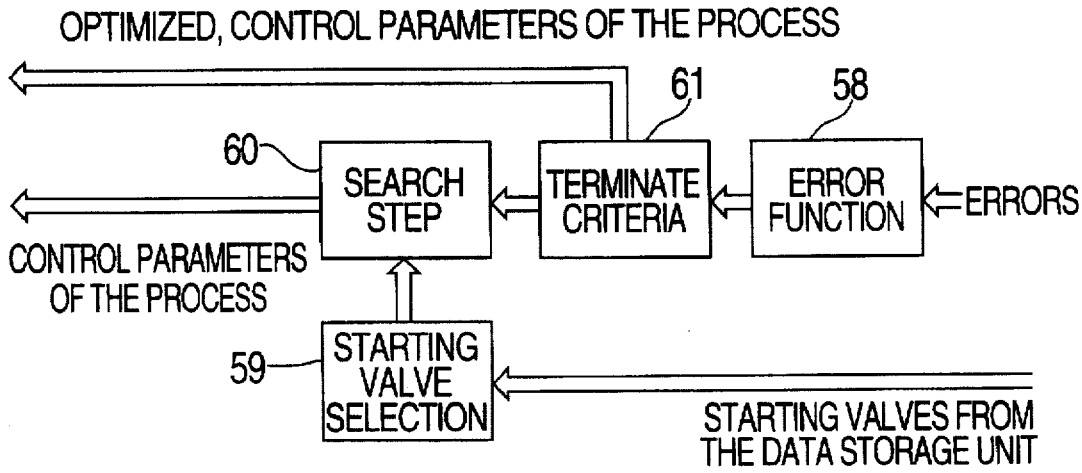
FIG. 3 shows details of the process optimizer.

In reference point 19, into which flow the setpoint values, e.g., in the selected exemplary embodiment, the setpoint values for the strip thickness, the profile shape, the surface quality of the strip, etc., the results from the model calculation are continually compared to the setpoint selections. The difference is then minimized by optimization. Since in technical processes, the difference generally cannot become zero, the optimization process must be sensibly limited, thus it must be specified when it is to be broken off. FIG. 3 shows the program structure in greater detail, with which the optimization is broken off and the new setpoint outputting is started, in each case.

In FIG. 3, 58 denotes an error function to be selected in each case, into which the ascertained errors flow (setpoint value deviations). It is now checked in 61 whether the error function fulfills the criteria for breaking off [terminating] the optimization. If this is the case, further optimized controlled variables and directly controlled variables are output. Before the terminate [break-off] criterion is reached, starting values arrive continually from the data storage unit into the starting value selection 59, from which open-loop control and closed-loop control parameters for a suboptimal process control are acquired in search step 60, not from the optimizer, but rather out of the data storage unit, e.g. with the help of a fuzzy interpolation. A switchover takes place after the predetermined quality factor is reached, which is adapted to the prevailing knowledge level of the control system. As already mentioned above, the minimization, which can never be absolute, is stopped when the preselected quality factor is reached.

It should also be mentioned that an alarm signal warning that critical operating states have been reached is also generated by the model when it is linked to the process, i.e., switch 1. Procedures of this type are already known and are also found in the same way in conventional control systems.

Figure 4:
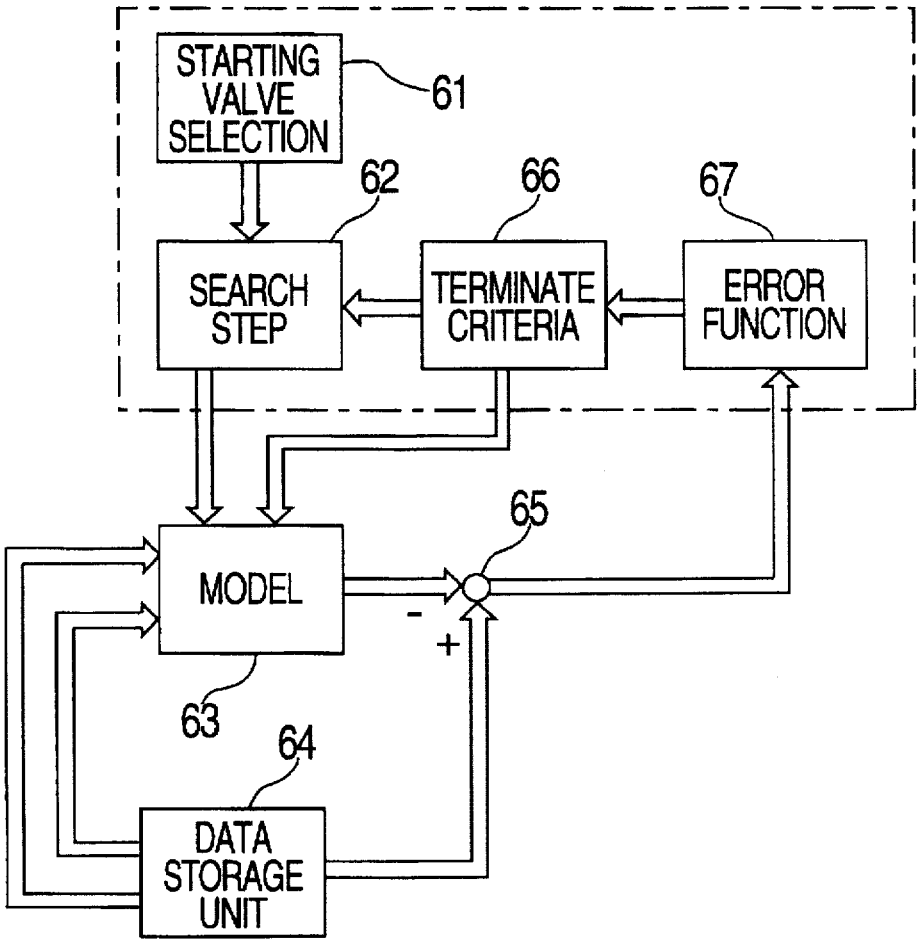
FIG. 4 shows details of the adaptation process.

In FIG. 4, which reveals the structure of a model adaptation by means of an optimization algorithm, data arrive from the starting value selection 61 into a search step unit 62 and are relayed from there as model parameters to the model 63. Together with the data storage unit 64, the model 63 forms a parameter improvement loop, which in 65 compares the generated and the stored values in a generally known manner. The comparison values are fed to the error function 67, which relays its value to the unit for terminating criteria 66. If the criteria for termination are fulfilled, the model is not improved further and the operation continues with the existing values. Otherwise, the optimization is continued with other search steps and with the intermediate values in the data storage unit.

Figure 5:
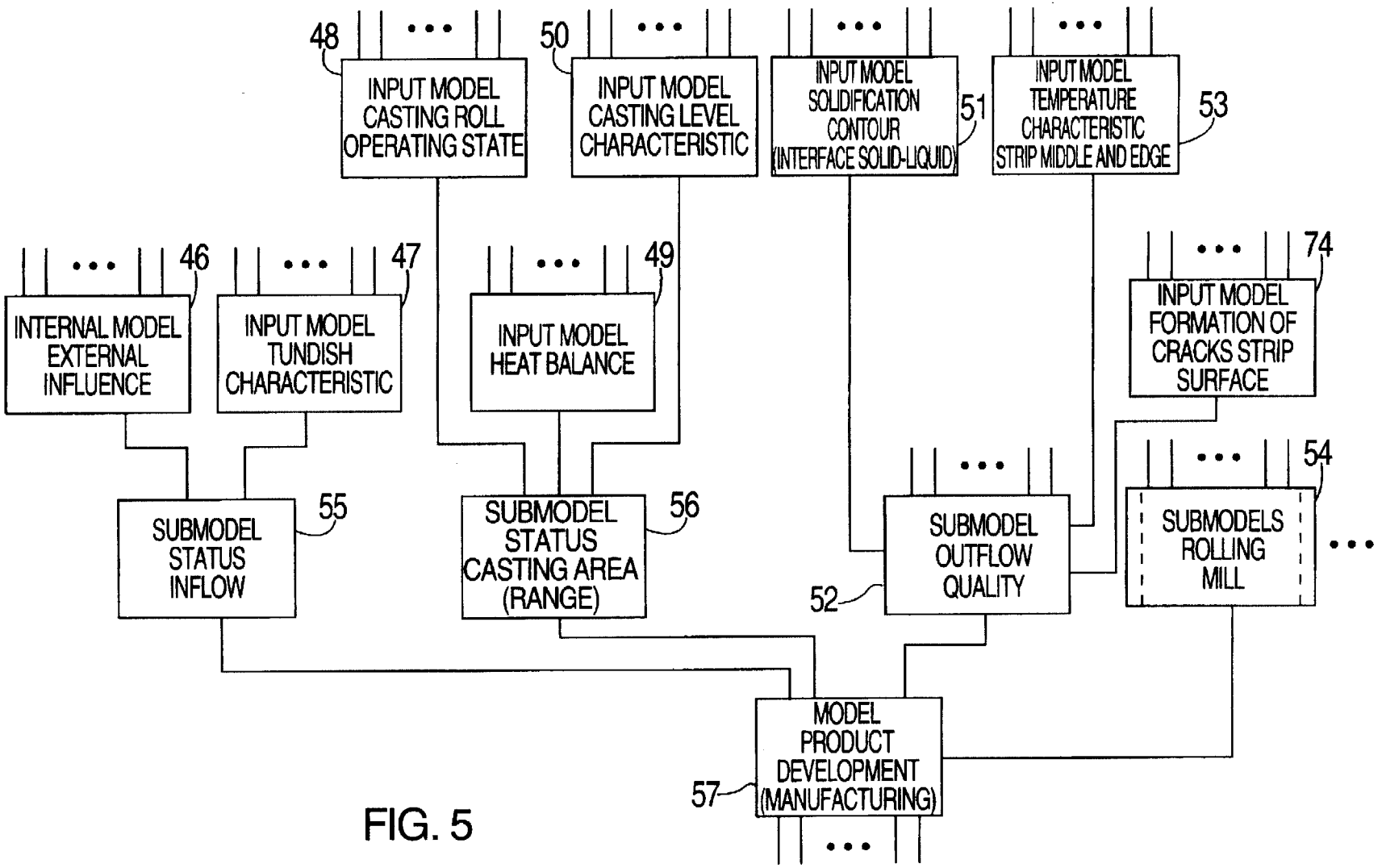
FIG. 5 shows essential components of the process model and their rough interconnection [logic] structure.

In FIG. 5, which shows the essential submodels of the complete process model of the exemplary embodiment, 46 denotes the input model in which the external influences, for instance the influences from the quality of the material being used, are compiled. From the steel charging quality, one obtains, e.g., the liquidus value, the solidus value, as well as other quantities characterizing the casting performance characteristics. 47 designates the tundish model, into which enter, for example, the steel volume of the tundish, the well position, or the like, the stopper position, and the steel outflow temperature. The input models 46 and 47 are combined in the submodel 56, which reproduces the status of the supplied material. Submodels of this type can be advantageously optimized in parallel with other submodels, for instance, with the casting-area model, the rolling-area model, or the like.

The input model 48 includes the influences affecting solidification, e.g. the casting roll cooling, the infrared heating, etc. The input model 49 contains the values necessary for heat balance, thus the steel casting-roll temperature difference, the influence of lubricants as a function of the quantity of lubricants, the speed of crystal formation of each of the types of steel, as well as, e.g., the roll surface state. The input model 50 contains, for example, the influences of the casting level characteristic, thus the casting level, the slag layer thickness and the radiation coefficient. The input models 48, 49 and 50 are combined in a submodel 54, which reproduces the status of the casting area. This model-area compilation is generally advantageous for production areas, since it simplifies and improves the overall model optimization. Among themselves, the submodels are still partially dependent upon one another, thus for instance, to a considerable extent, the input models 49 (heat-balance input model) and 50 (casting-level-characteristic input model). Secondary dependencies are not shown for the sake of simplicity.

The submodel 51 includes all influences on the solidification front, i.e., the location where the area where metal shells solidify at the two cooling rolls meet. Essentially, these influences are the deformation work which is performed by the casting rolls, the vibrational amplitude of the casting rolls or of the emerging strip, the side-gap packing influences and the degree of effort of the overall system; this is a fuzzy model, for example. The submodel 52 reproduces the outflow values, thus, for example, the quality of the strip, the outflow temperature and distribution, but also the adhesion inclination and condition of the formed scab. Also entering into the submodel 52 are the input model 53 and the input model 74, which relate to the temperature characteristic transversely to the strip and to the surface condition of the strip. For the especially advantageous case, that a strip-casting rolling mill is involved, the rolling mill submodels 54 also go into this special process model, since the product development after emerging from the roll stands is the decisive criterion.

The submodels are combined to form the product development model 57, which combines the thickness profile of the formed strip, the strip thickness, a possibly emerging error image, the grain structure of the strip, the surface structure, etc. The surface structure and, in particular the grain structure of the strip can only be determined with a considerable time delay. Therefore, one work advantageously with submodels based on neural networks to qualitatively and quantitatively determine influence variables.

From the above description, one attains, in particular, the special advantage of being able to process the parts of a complex, complete process model in parallel, since the model is developed in a modular-like form. This is especially advantageous in view of the time interval needed to put an installation into operation, in that the input models and submodels must be adapted to the actual conditions, and must be interlinked with one another, etc.

Figure 6:
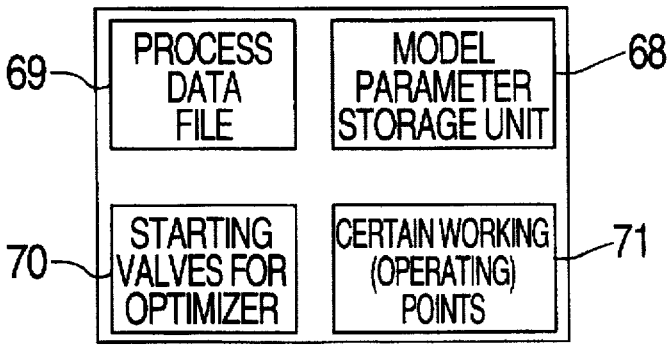
FIG. 6 shows parts of the data storage device essential to the present invention.

Finally, FIG. 6 shows the part of the data storage unit structure essential to the present invention. 69 denotes the process data archive, 68 the model parameter storage section, 70 the part with the starting values for the optimizer, and 71 the storage section for the certain working points. The specific model design is also stored in 68.

The basic automation, which with its closed-loop controls, open-loop controls, interlocking circuits, etc. constitutes an indispensable part of the control system, since it guarantees, inter alia, the reliable functioning of the installation also in the case of a malfunction of the model part of the control system working according to the present invention, must fulfill a plurality of functions.

Figure 7:
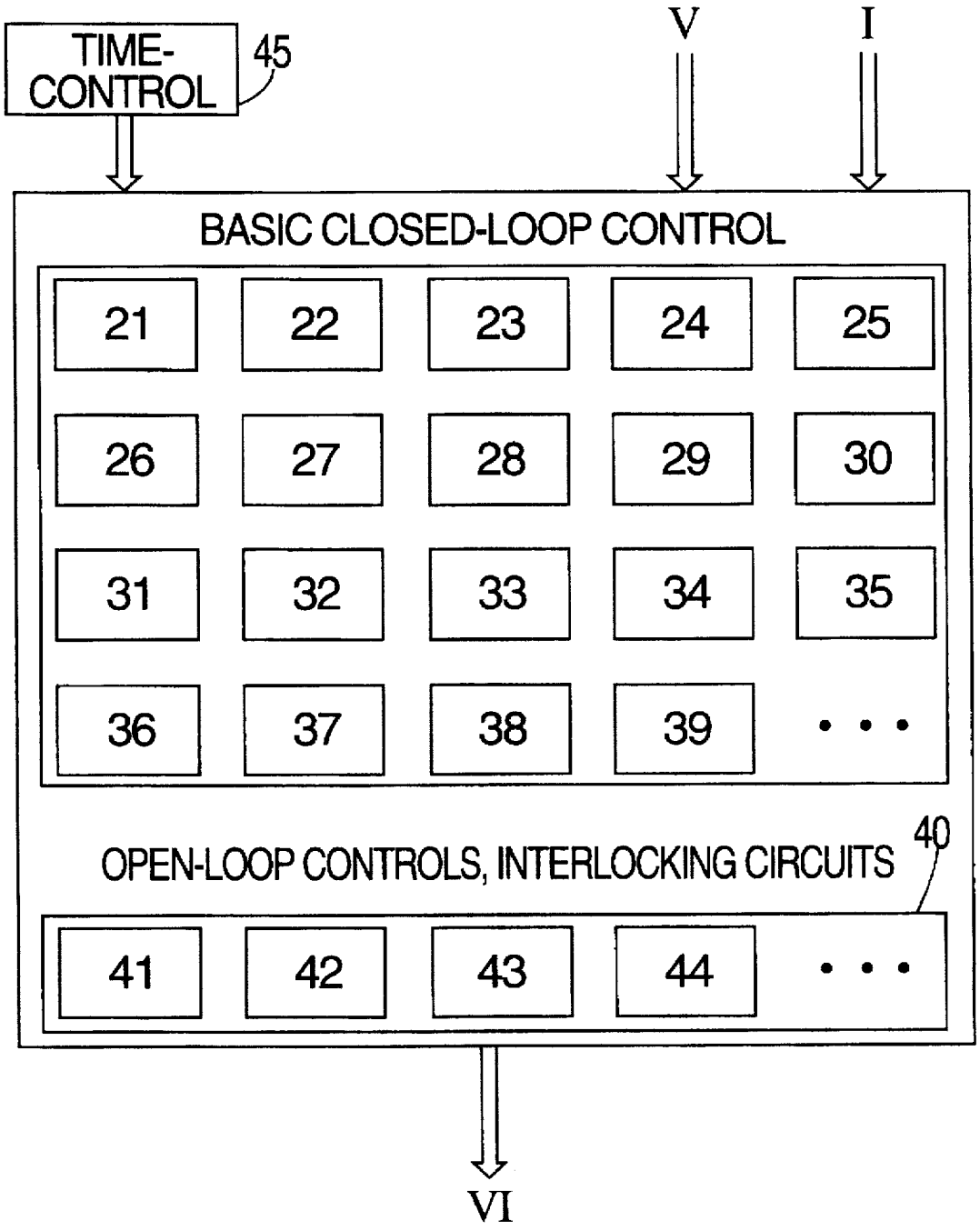
FIG. 7 shows a diagrammatic representation of components of the basic automation.

The individual functions are symbolized, not conclusively, by the individual "black boxes" in FIG. 7. In the exemplary embodiment here, 21 signifies the mass flow control via the individual speed controller, 22 the control of the tundish heating, 23 the casting level control, 24 the tundish outflow control, and 25 the heating capacity of the infrared, or the like, screen 7 for maintaining the operating temperature of the casting rolls. 26 signifies controlling the addition of lubricants, e.g. in the form of loose casting powder or of casting powder paste applied to the casting rolls, 27 the control of cooling water quantity, 28, in some instances, the control of roll oscillation, 29 the electrical drive control, and 30 the roll nip adjustment. 31 denotes the roll speed control, and 32, in some instances, the control of the moment of rotation of the rolls, 33 the adjustment of the cleaning system, consisting, for example, of a brush and a scraper for the casting rolls, and 34 the control of the electrodynamic system for compensating for the weight of the strip, as well as 35 the controlling of the vibrational amplitude of the cast strip. 36 signifies controlling the individual parts of an electrodynamic system for sealing side gaps, and 37 controlling the side wall heating for the space between the casting rolls. 38 denotes controlling the temperature profile of the induction heating system 10. 39, as well as other control units alluded to, refer to controlling downstream deformation units, e.g. roll stands, the tension between the roll stands, etc. The time control 45, which coordinates the manipulated variable outputs, etc., as a function of time, acts on the above actuators, controllers, etc. The auxiliary controls and the interlocking circuits are combined by way of example in block 40, thus, e.g. 41 signifies the start-up automatic system, 42 the switch-off automatic system, 43 and 44 interlocking circuits, which prevent, e.g. molten steel from being able to flow before the casting roll pair and the deformation rolls are operational, etc. In addition, other systems (not shown in the overview diagram) are present for the sometimes necessary separation of strip edges, e.g. by means of lasers, for influencing scab formation, e.g. by means of silicate formation, roll lubrication, etc. The manipulated variables VI, by means of which the installation is controlled, are generated in the basic automation, into which enter the measuring data I and the setpoint selections V.

The characteristic of the control system that is self-optimizing and further developed in terms of knowledge, shown based on the example of the casting roll process, is clarified in greater detail in the following:

The casting roll process is comprised of a number of subprocesses, whose development and influences are decisive for the final product. The properties of the final product, e.g. its thickness, its thickness profile, and its surface formation, are able to be influenced and optimized in accordance with the present invention by a series of adjustable process variables, such as the casting roll nip, the casting roll profile, the casting level, etc., which influence, in turn, the position of the merging zone of the metal shells deposited and solidified on the casting rolls. A complete process model, which describes the process performance characteristics, is advantageously created in accordance with the present invention for a control and optimization. On the basis of this process model, the influence variables that one uses to influence the process are adapted and optimized step-by-step in accordance with the process conditions. The instructions that are applicable to the prevailing situation and are defined by this optimization lead then to an improvement in the process evolution. Overall therefore, considerable cost advantages are attained, in spite of the relatively expensive software used in creating the process model (the software can still be used with less expenditure for other installations), since the installation can work with considerably fewer mechanical components, fewer controllers, etc., than the known installations. The sensor technology also becomes substantially simpler, since only the process output variables have to be precisely detected on an ongoing basis.

The intelligent, self-improving part of the control system is comprised of three essential elements: the process model, the model adaptation, and the process optimizer. The process model is composed of subsystems (modules), which become different types depending on the process knowledge. When the physical interrelationships are known, classical physico-mathematical models can be created. If, on the other hand, one only has empirical knowledge or estimates at one's disposal, then fuzzy or neuro-fuzzy systems are used. If one knows only little or nothing about the process performance characteristics, for instance in the case of the crack formation and the surface formation, then neural networks are used, at least in the beginning, for the process development. Overall therefore, the model describes the interrelationship among the process variables, as in the selected example, the casting level, the state values, and the quality of the cast material, the adjustment values of the casting rolls, etc., and the quality parameters of the strip, e.g. the thickness, the profile, and the surface formation.

Since the model is based to a certain, possibly considerable extent on uncertain knowledge, it is not precise. Thus, the model must be adapted, modified, etc. on the basis of acquired process data. This takes place advantageously, on the one hand, by means of the known model adaptation, which is added to data of preceding process states. On the basis of these data, it adjusts the model parameters, or the like, such that the model performance characteristics correspond as best as possible to those of the process. Moreover, the models are optimized in that they automatically modify themselves, thus, for example, by means of genetic algorithms, a combinatorial evolution, etc. Such optimization strategies are known, e.g. from Ulrich Hoffmann, and Hanns Hofmann in "Einführung in die Optimierung" [Introduction to the Optimization], published by Verlag Chemie GmbH, 1971 Weinheim/Bergstraße; H. P. Schwefel in "Numerische Optimierung von Computer-Modellen mittels der Evolutionsstrategie" [Numerical Optimization of Computer Models by means of the Evolution Strategy], Basel, Stuttgart: Birkhäuser 1977; Eberhard Schöneburg in "Genetische Algorithmen und Evolutionsstrategien" [Genetic Algorithms and Evolution Strategies], Bonn, Paris, Reading, Mass, Addison-Wesley, 1994; and Jochen Heistermann "Genetische Algorithmen: Theorie und Praxis evolutionarer Optimierung" [Genetic Algorithms: Theory and Practice of Evolutionary Optimization], Stuttgart, Leipzig, Teubner, 1994 (Teubner-Texte zur Informatik [Teubner Texts for Information Studies]; volume 9).

The control system according to the present invention, together with the above described procedure according to the present invention, make it possible to abandon the design structure of a control method existing in known methods heretofore. Above a basic automation, which relates essentially to the process level (level I), there is only one single-stage, intelligent control method to which the setpoint values for production are specified and which automatically generates all selection variables (control commands) (level II). Because of the process result already achieved, continually better process results are assured in an intelligent self-optimization. Individual feedback control circuits can be eliminated. Quality-controlling sensors are only needed for controlling the process results. Thus, the control system according to the present invention has only two more essential levels, of which except for programming, for instance, the intelligent level does not require any visualization. For control purposes, however, the elements of the basic automation can be visualized in a generally known way.

What is claimed is:

1. A method for controlling a primary industry plant, like one of a steel plant or a steel mill producing strips of one of steel and non-ferrous metals, the control method being implemented on one of a computer and a system of distributed computers, the control method comprising the steps of:

adapting a model of operation of the primary industry plant;

carrying out an optimization process using advance knowledge of the primary industry plant and knowledge about the status of the primary industry plant obtained from the model; and calculating, in terms of the optimization process, at least one of a setpoint value and a desired value respecting one of safety, reliability, and throughput of the primary industry plant and quality of a processed product, for use in one of driving at least one actuator of the primary industry plant and feeding to at least one controller controlling the at least one actuator.

2. The control method according to claim 1, further comprising the steps of:

improving the advance knowledge by computer-generated knowledge gained from the model during production in the primary industry plant; and accepting the computer-generated knowledge as a new advance knowledge in a data storage unit.

3. The control method according to claim 1, further comprising the steps of:

giving at least one instruction applicable to a situation directly to at least one primary industry plant component in the form of a selection value, for at least a position; and giving at least one instruction applicable to a situation indirectly via the controller setpoint values, for at least a rotational speed.

4. The control method according to claim 1, wherein a basic function system for at least one primary industry plant component reliably converts the instructions from the knowledge gained computationally from the model into the primary industry plant control.

5. The control method according to claim 4, wherein the basic function system is designed as a basic automation system, which reliably renders each of the primary industry plant components operational.

6. The control method according to claim 4, wherein the basic function system obtains the setpoint values directly from an intelligent part of a control computer which determines the setpoint values from the results of one of the steps of the adaptation and the optimization processes on the model.

7. The control method according to claim 4, wherein the basic function system is developed as an autonomous subsystem that guarantees a reliable condition of the primary industry plant and of an emergency-condition release system, which instead of falling back on the computer-generated instructions, can fall back on positively identified operational values stored in the data storage unit.

8. The control method according to claim 4, wherein the basic function system has a starting and run-up routines, which can be entered in one of a manual and automatic manner, as well as a suboptimal normal operating routine, in which individual, otherwise computer-generated instructions can be replaced by constant setpoint values.

9. The control method according to claim 1, wherein the state of the primary industry plant and of the individual primary industry plant components is continually simulated for purposes of the optimization step on the basis of a process model, which in particular has a modular design, and which describes the performance characteristics among a plurality of process input variables, as well as a plurality of manipulated variables, and a plurality of process output variables.

10. The control method according to claim 9, wherein the process model has mathematical descriptive forms, at least in part, to the extent that it can be modelled on the basis of one of physico-mathematical, chemical, metallurgical, and biological laws.

11. The control method according to claim 9 wherein for the primary industry plant components for which there is existing process knowledge that can only be expressed linguistically, the process model has linguistically formulated model sections, which can be realized by one of fuzzy systems, neuro-fuzzy systems, expert systems, and tabular compilations.

12. The control method according to claim 9, wherein for the primary industry plant components for which it is not possible to produce a model based on the fundamentals of one of mathematical physics, chemistry, metallurgy and biology, and on a linguistically describable process knowledge, the process model has at least one self-learning system, such as a neural network.

13. The control method according to claim 12, wherein the starting values for an optimization are determined on the basis of the suboptimal operational data filed in a process data storage unit.

14. The control method according to claim 9, wherein the process model is continually adapted to the process and corrected on the basis of process data, which has been collected at the primary industry plant and filed in a process data base, and in that this is accomplished by means of one of adaptive methods and learning methods, by one of means of a back-propagation learning method, and a selection method for various submodels, such as a neural network.

15. The control method according to claim 9, wherein the process variables are optimized off-line by an optimizer at the process model so as to allow the model output variables, which, in particular, are quality parameters for the product, to conform as best as possible to preselected target values.

16. The control method according to claim 9, wherein the step of optimization takes place using a known optimization method such as one of a genetic algorithm, the Hooke-Jeeves method, a simulated annealing method and the like, and that the optimization method applied in each case is specified in dependence upon the situation and the problem and is selected from a data file in dependence upon one of the number of variables to be optimized and the formation of the minima to be expected.

17. The control method according to claim 16, wherein the criteria for breaking off the optimization methods, such as with the neural networks, are determined according to one of a method of pattern recognition and classical convergency criteria on the basis of the course of the optimization.

18. The control method according to claim 9, wherein the step of optimization takes place off-line on the basis of the process model, adjustable process variables, which were so determined that the characteristic values of the manufactured product simulated by the model conform as best as possible to the predetermined desired values, being given as setpoint values to the basic function system of the process, and the process being adjusted by the basic function system in accordance with the setpoint values.

19. The control method according to claim 9, wherein in the case of a malfunction of one of the model and the optimizer, the setpoint values can be generated directly from the data of the process data base, an interpolation being performed to improve the setpoint values, in particular between the stored operational data.

20. The control method according to claim 9 wherein the model takes into consideration one of the restrictions of the manipulated variables, the actuator time response and, in some instances, the process dynamic, preferably in and before the area of the casting rolls, such as in relation to the position of the merging zone of the solidification shells for the solidification shells deposited on the casting rolls.

* * * * *